US009120591B2

(12) United States Patent
Staples et al.

(10) Patent No.: US 9,120,591 B2
(45) Date of Patent: Sep. 1, 2015

(54) PLASTIC CONTAINER NECK CONFIGURED FOR USE WITH A FITMENT

(71) Applicants: Don Staples, Lawrenceville, GA (US); Gary Mengeu, Wheeling, WV (US); Laura Flanagan-Kent, Decatur, GA (US); Fred P. Minkemeyer, Rayland, OH (US)

(72) Inventors: Don Staples, Lawrenceville, GA (US); Gary Mengeu, Wheeling, WV (US); Laura Flanagan-Kent, Decatur, GA (US); Fred P. Minkemeyer, Rayland, OH (US)

(73) Assignee: Silgan Plastics LLC, Chesterfield, MO (US)

( * ) Notice: Subject to any disclaimer, the term of this patent is extended or adjusted under 35 U.S.C. 154(b) by 105 days.

(21) Appl. No.: 14/078,110

(22) Filed: Nov. 12, 2013

(65) Prior Publication Data

US 2015/0129592 A1 May 14, 2015

(51) Int. Cl.

| | |
|---|---|
| ***B65D 47/18*** | (2006.01) |
| ***B65D 1/02*** | (2006.01) |
| ***B65D 41/04*** | (2006.01) |
| ***B65D 51/18*** | (2006.01) |

(52) U.S. Cl.

CPC ..... *B65D 1/0246* (2013.01); *B65D 41/0428* (2013.01); *B65D 51/18* (2013.01); *B65D 2251/0075* (2013.01)

(58) Field of Classification Search

CPC ..... B65D 2251/0075
USPC ..... 215/364, 355, 228, 297, 296, 295
See application file for complete search history.

(56) References Cited

U.S. PATENT DOCUMENTS

| | | | | |
|---|---|---|---|---|
| 4,378,891 | A * | 4/1983 | Fowles et al. | 215/48 |
| 4,478,342 | A * | 10/1984 | Slater et al. | 215/48 |
| 5,065,908 | A * | 11/1991 | Mengeu | 222/480 |
| 5,547,275 | A * | 8/1996 | Lillelund et al. | 366/130 |
| 2010/0252524 | A1 * | 10/2010 | Dubs et al. | 215/277 |

OTHER PUBLICATIONS

Screen Shot 1 Gallon Milk Jugs 5-16912-Uline, available at http://www.uline.com/Product/Detail/S-169-12/, dated Oct. 22, 2013, 1 page.

PCF—26P—1 Voluntary Standard Flatwater Finish engineering drawing available at http://www.threadspecs.com/threadspecs-downloads.asp, dated May 27, 2010, accessed on Oct. 22, 2013, 1 page.

PCF—26P—2 Voluntary Standard Flatwater Finish engineering drawing available at http://www.threadspecs.com/threadspecs-downloads.asp, dated May 27, 2010, accessed on Oct. 22, 2013, 1 page.

Alcoa—1716 Voluntary Standard 28mm CSD finish engineering drawing available at http://www.threadspecs.com/threadspecs-downloads.asp, dated Apr. 15, 1999, accessed on Oct. 22, 2013, 1 page.

(Continued)

*Primary Examiner* — Steven A. Reynolds
*Assistant Examiner* — King M Chu
(74) *Attorney, Agent, or Firm* — Reinhart Boerner Van Deuren s.c.

(57) ABSTRACT

An apparatus is provided in the form of a neck for a plastic bottle or other plastic container. The neck includes an external thread with a constant major diameter that can engage with a bottle cap with an internal thread. The neck has an internal surface with an irregular shape where the internal diameter proximate to the top sealing surface is greater than the internal diameter proximate to the side wall of the plastic bottle. The internal surface of the neck engages with a fitment inserted into the neck of the plastic container to prevent movement of the fitment.

26 Claims, 6 Drawing Sheets

(56) References Cited

OTHER PUBLICATIONS

Alcoa—1788 Voluntary Standard 28mm CSD finish engineering drawing available at http://www.threadspecs.com/threadspecs-downloads.asp, dated Apr. 15, 1999, accessed on Oct. 22, 2013, 1 page.
BPF-C Voluntary Standard 28mm CSD finish engineering drawing available at http://www.threadspecs.com/threadspecs-downloads.asp, dated Oct. 19, 2000, accessed on Oct. 22, 2013, 1 page.
Obrist—28 (19mm) Voluntary Standard Flatwater Finish engineering drawing available at http://www.threadspecs.com/threadspecs-downloads.asp, dated Feb. 23, 1999, accessed on Oct. 22, 2013, 1 page.
Obrist—28 (18mm) Voluntary Standard Flatwater Finish engineering drawing available at http://www.threadspecs.com/threadspecs-downloads.asp, dated Feb. 23, 1999, accessed on Oct. 22, 2013, 1 page.
PCO—1810 Voluntary Standard 28mm CSD Finish engineering drawing available at http://www.threadspecs.com/threadspecs-downloads.asp, dated May 29, 1998, accessed on Oct. 22, 2013, 1 page.
PCO—1815 Voluntary Standard 28mm CSD Finish engineering drawing available at http://www.threadspecs.com/threadspecs-downloads.asp, dated May 29, 1998, accessed on Oct. 22, 2013, 1 page.
PCO—1816 Voluntary Standard 28mm CSD Finish engineering drawing available at http://www.threadspecs.com/threadspecs-downloads.asp, dated May 29, 1998, accessed on Oct. 22, 2013, 1 page.
PCO—1817 Voluntary Standard 28mm CSD Finish engineering drawing available at http://www.threadspecs.com/threadspecs-downloads.asp, dated May 29, 1998, accessed on Oct. 22, 2013, 1 page.
PCO—1820 Voluntary Standard 28mm CSD Finish engineering drawing available at http://www.threadspecs.com/threadspecs-downloads.asp, dated May 29, 1998, accessed on Oct. 22, 2013, 1 page.
PCO—1823 Voluntary Standard 28mm CSD Finish engineering drawing available at http://www.threadspecs.com/threadspecs-downloads.asp, dated May 29, 1998, accessed on Oct. 22, 2013, 1 page.
PCO—1881 Voluntary Standard 28mm CSD finish engineering drawing available at http://www.threadspecs.com/threadspecs-downloads.asp, dated Feb. 14, 2007, accessed on Oct. 22, 2013, 1 page.
PCF—33P—1 Voluntary Standard Hot Fill Finish engineering drawing available at http://www.threadspecs.com/threadspecs-downloads.asp, dated Dec. 10, 1999, accessed on Oct. 22, 2013, 1 page.
Alcoa—1690 Voluntary Standard 38mm CSD finish engineering drawing available at http://www.threadspecs.com/threadspecs-downloads.asp, dated Jun. 6, 2001, accessed on Oct. 22, 2013, 1 page.
PCF—38P—1 Voluntary Standard Hot Fill Finish engineering drawing available at http://www.threadspecs.com/threadspecs-downloads.asp, dated Dec. 10, 1999, accessed on Oct. 22, 2013, 1 page.
PCF—38P—2 Voluntary Standard Hot Fill Finish engineering drawing available at http://www.threadspecs.com/threadspecs-downloads.asp, dated Dec. 10, 1999, accessed on Oct. 22, 2013, 1 page.
PCF—38G—3 Voluntary Standard Hot Fill Finish engineering drawing available at http://www.threadspecs.com/threadspecs-downloads.asp, dated Dec. 10, 1999, accessed on Oct. 22, 2013, 1 page.
PCF—38P—4 Voluntary Standard Hot Fill Finish engineering drawing available at http://www.threadspecs.com/threadspecs-downloads.asp, dated Dec. 10, 1999, accessed on Oct. 22, 2013, 1 page.
PCF—38P—5 Voluntary Standard Non-Carbonated Beverage Finish (Extrusion Blown) engineering drawing available at http://www.threadspecs.com/threadspecs-downloads.asp, dated Nov. 21, 200, accessed on Oct. 22, 2013, 1 page.
PCO—38 Voluntary Finish 38mm CSD Finish engineering drawing available at http://www.threadspecs.com/threadspecs-downloads.asp, dated Oct. 19, 2000, accessed on Oct. 22, 2013, 1 page.
PCF—43P—1 Voluntary Standard Hot Fill Finish engineering drawing available at http://www.threadspecs.com/threadspecs-downloads.asp, dated Jan. 17, 2000, accessed on Oct. 22, 2013, 1 page.
PCF—48P—2 Voluntary Standard Hot Fill Finish engineering drawing available at http://www.threadspecs.com/threadspecs-downloads.asp, dated Jan. 17, 2000, accessed on Oct. 22, 2013, 1 page.
PCF—48P—3 Voluntary Standard Hot Fill Finish engineering drawing available at http://www.threadspecs.com/threadspecs-downloads.asp, dated Jan. 17, 2000, accessed on Oct. 22, 2013, 1 page.
PCF—48P—4 Voluntary Standard Hot Fill Finish engineering drawing available at http://www.threadspecs.com/threadspecs-downloads.asp, dated Jan. 17, 2000, accessed on Oct. 22, 2013, 1 page.
PCF—48P—5 Voluntary Standard Hot Fill Finish engineering drawing available at http://www.threadspecs.com/threadspecs-downloads.asp, dated Jan. 17, 2000, accessed on Oct. 22, 2013, 1 page.
SP—400 Voluntary Standard engineering drawing available at http://www.threadspecs.com/threadspecs-downloads.asp, dated Mar. 10, 1999, accessed on Oct. 22, 2013, 1 page.
SP—410 Voluntary Standard engineering drawing available at http://www.threadspecs.com/threadspecs-downloads.asp, dated Mar. 10, 1999, accessed on Oct. 22, 2013, 1 page.
SP—415 Voluntary Standard engineering drawing available at http://www.threadspecs.com/threadspecs-downloads.asp, dated Mar. 10, 1999, accessed on Oct. 22, 2013, 1 page.
Voluntary Standard PET Finish Dimension Nomenclature engineering drawing available at http://www.threadspecs.com/threadspecs-downloads.asp, dated May 29, 1998, accessed on Oct. 22, 2013, 1 page.
Terminologies for Bottle Finishes available at http://www.threadspecs.com/threadspecs-downloads.asp, dated Jun. 12, 2001, accessed on Oct. 22, 2013, 1 page.
Terminologies for Finish features available at http://www.threadspecs.com/threadspecs-downloads.asp, © 2001, accessed on Oct. 22, 2013, 1 page.
TFRSC Nomenclature available at http://www.threadspecs.com/threadspecs-downloads.asp, © 2000, accessed on Oct. 22, 2013, 1 page.
CSD Chart available at http://www.threadspecs.com/threadspecs-downloads.asp, accessed on Oct. 22, 2013, 1 page.
Hot-Fill Chart available at http://www.threadspecs.com/threadspecs-downloads.asp, accessed on Oct. 22, 2013, 1 page.
Flat Water Chart available at http://www.threadspecs.com/threadspecs-downloads.asp, dated Dec. 12, 2011, accessed on Oct. 22, 2013, 1 page.
SPI-Series Chart available at http://www.threadspecs.com/threadspecs-downloads.asp, accessed on Oct. 22, 2013, 1 page.

* cited by examiner

PLASTIC CONTAINER NECK CONFIGURED FOR USE WITH A FITMENT

BACKGROUND OF THE INVENTION

The present invention relates generally to the field of containers. The present invention relates specifically to a neck for a plastic bottle an internal surface with a frustoconical or variable shape configured to improve the interaction between the neck and an insert or fitment. The neck is further configured to include a relatively constant thickness neck wall and an external thread with a constant major diameter.

SUMMARY OF THE INVENTION

One embodiment of the invention relates to an apparatus in the form of a neck for a plastic container. The neck includes a top sealing surface. The neck further includes at least one thread, and may include more than one thread. The major diameter of the thread or threads is constant along the vertical axis of the neck. The minor diameter of the thread or threads is greatest adjacent to the top sealing surface, and decreases along the distance of the neck. The thread or threads are formed integrally with the top sealing surface and a layer of material of substantially constant thickness. The layer of material has an internal diameter that is greatest adjacent to the top sealing surface, and that decreases along the distance of the neck. The layer of material extends from the top sealing surface to the shoulder of the plastic container. The shoulder of the plastic container is integrally formed with the plastic container, and is adjacent to the sidewall of the plastic container. The shoulder of the plastic container is configured to inhibit the upward movement or removal of a fitment inserted into the neck of the plastic bottle. The neck for the plastic container may also include a bead on either the internal surface of the layer of material or on the external surface of the neck below the one or more threads.

Another embodiment of the invention relates to an apparatus in the form of a threaded neck for a plastic bottle. The threaded neck includes a neck side wall. The threaded neck also includes a top sealing surface and a shoulder. The shoulder couples the neck side wall with the side wall of the plastic bottle. The neck side wall has a substantially uniform thickness but an irregular shape that creates a frustoconical internal surface. The neck side wall extends from the top sealing surface of the threaded neck to the shoulder of the plastic bottle. The neck side wall has a first internal diameter proximate to the top sealing surface that is greater than a second internal diameter proximate to the shoulder of the plastic bottle. The threaded neck also includes at least one thread that extends around the exterior surface of the neck side wall. The thread or threads have a constant diameter as measured at the crest of one or more threads. The thread or threads have a first diameter as measured at the root of the thread adjacent to the top sealing surface that is greater than a second diameter as measured at the root of the thread adjacent to the shoulder of the plastic bottle.

Another embodiment of the invention relates to an apparatus in the form of a plastic bottle. The plastic bottle includes a side wall integrally formed with a bottom surface, forming an internal cavity capable of holding contents. The plastic bottle further includes a neck defined by a neck wall. The neck wall extends from a top sealing surface to a shoulder of the plastic bottle. The shoulder couples the neck to the side wall, and is integrally formed with the neck and the side wall. The shoulder forms an internal rim within the plastic bottle. The plastic bottle may also include a cap. The cap includes a substantially planar top surface, a skirt extending downwards from the substantially planar top surface, and at least one thread on the internal surface of the skirt of the bottle cap. The thread or threads of the bottle cap engage with the thread or threads of the neck wall of the plastic bottle.

The neck wall of the plastic bottle in the above embodiment defines a frustoconical interior surface of the neck. The neck wall has a first internal diameter proximate to the top sealing surface that is greater than a second internal diameter proximate to the shoulder. The neck also includes at least one thread that extends around the exterior surface of the neck wall. The major diameter of thread as measured at a crest of the thread is constant, but a first minor diameter of the thread as measured at the root of the thread adjacent to the top sealing surface is greater than a second minor diameter of the thread as measured at the root of the thread adjacent to the shoulder of the plastic bottle. The neck wall also includes a recess adjacent to the top sealing surface. The plastic bottle further includes a fitment, which includes a skirt connecting an upper flange and a lower flange. The upper flange of the fitment engages with the recess of the neck wall to prevent the fitment from sliding into the cavity of the plastic bottle. The lower flange of the fitment engages with the internal rim of the shoulder of the plastic bottle to prevent the fitment from exiting the neck of the plastic bottle.

Alternative exemplary embodiments relate to other features and combinations of features as may be generally recited in the claims.

BRIEF DESCRIPTION OF THE DRAWINGS

This application will be more fully understood from the following detailed description, taken in conjunction with the accompanying figures, wherein like reference numbers refer to like elements in which.

DETAILED DESCRIPTION

Referring generally to the figures, various embodiments of an apparatus in the form of a threaded neck for a plastic bottle are described. The threaded neck is defined by an irregular internal diameter combined with an external thread with a constant major diameter. The irregular internal shape of the neck secures an insertable fitment in the neck of the plastic bottle. The regular major diameter of the external thread ensures that a standard cap with a constant internal diameter and a thread on the internal surface of the cap can engage with the external thread of the neck to seal the plastic bottle.

Insertable fitments offer certain benefits over other methods of altering the closure area of plastic bottles. Fitments can be constructed out of any combination of materials, but because they can be held in place by mechanical forces, they do not have to incorporate an adhesive layer. Consequently, a fitment can be constructed out of a single material, often a thermoplastic, leading to certain efficiencies in the manufacturing process. Unlike other methods of altering the closure area of a plastic bottle, a fitment can be inserted after the bottle is filled. Most importantly, an insertable fitment increases the functionality of a plastic bottle, by performing tasks such as creating a better pouring experience for the consumer, providing obstructions to filter out or break up lumps in the contents of the plastic bottle, or create a spill-proof opening.

Figure 1:
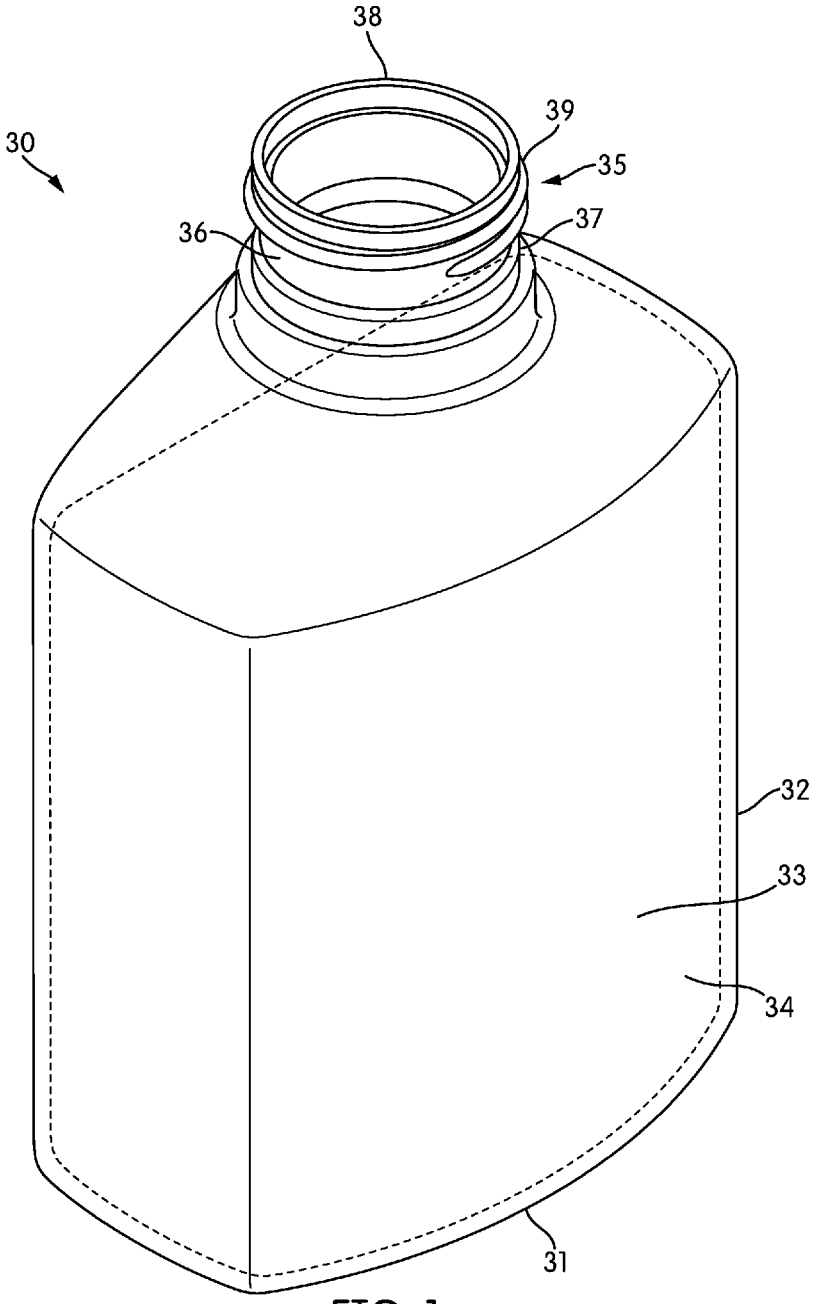
FIG. 1 is a perspective view of an embodiment of a threaded neck on a plastic bottle.

Referring to FIG. 1, a bottle 30 is shown according to an exemplary embodiment. The bottle 30 includes a bottom surface 31 and a side wall 32. The bottom surface 31 and the side wall 32 enclose a cavity 33 that may be filled with contents 34. The side wall 32 of the bottle 30 is coupled to the neck 35 of the bottle 30 as defined by the neck wall 36 by the shoulder 37 of the plastic bottle 30. The shoulder 37 is typically integrally formed out of the same material as the side wall 32 and the neck wall 36. The neck wall 36 extends upward from the shoulder 37 until it terminates in the top sealing surface 38. The bottle includes a thread 39 integrally formed with the exterior surface of the neck wall 36.

In one embodiment of the apparatus discussed herein, the bottle 30 has a height of approximately 5.755 inches. In this embodiment, the bottle 30 has a width of approximately 4.250 inches and a depth of approximately 2.898 inches. In this embodiment, the side wall 32 is approximately 0.030 inches thick. In alternate embodiments, the bottle 30 has a height between approximately 1.000 inches and approximately 10.000 inches. In alternate embodiments, the bottle 30 has a width between approximately 0.750 inches and approximately 5.625 inches and a depth between approximately 0.750 inches and approximately 5.625 inches. The dimensions in these embodiments are only exemplary; dimensions may be higher or lower than the ranges suggested above depending on the application of the fitment 60, the application of the bottle 30, or the contents 34 of the bottle 30.

Notwithstanding the exemplary embodiments discussed above, the bottle may have various widths, heights, and depths not discussed herein. In alternate embodiments, various measurements in ranges around the absolute and relative bottle dimensions disclosed herein may be used for the width, height, and depth characteristics of the bottle.

In the embodiment of a bottle shown, the shape of a cross-section taken perpendicular to the longitudinal axis of the bottle is four convex lines joined at four angles of equal size. In another possible embodiment, the shape of a cross-section of the bottle taken perpendicular to the longitudinal axis of the bottle is generally circular. In alternate embodiments, the shape of a cross-section of the bottle taken perpendicular to the longitudinal axis of the bottle may be a variety of shapes (e.g., a polygon, an ellipse, etc.). In various embodiments, the sidewall of the bottle 30 may include one or more axially extending side wall 32 sections that are curved radially inwardly or outwardly such that the diameter of the side wall 32 of the bottle 30 is different at different places along the axial length of the bottle, and such curved sections may be smooth continuous curved sections.

In various embodiments of the apparatus discussed herein, the contents 34 of the bottle 30 may be a particulate solid, a liquid, a solution, a gel, a paste, a powder, etc. The contents 34 may be a product for consumption such as a food, a beverage, a medicine, a dietary supplement, etc., or the contents 34 may be a product for use such as a paint, a solvent, a cleaning solution, a perfume, a fuel, an ink, a fertilizer, or other non-perishable material.

In alternate embodiments, the apparatus may not be a plastic bottle but may instead be another type of a plastic container. The plastic container may be in another form (e.g., a jug, a pouch, a box, a can, a barrel, a tube, etc.). In some embodiments, the container is made from a relatively rigid thermoplastic material (e.g., polypropylene, high density polyethylene, polyethylene terephthalate, polystyrene, etc.). Depending on the intended contents of the container, the container may be formed out of multiple layers of different plastics. In various embodiments, the plastic container may be clear or opaque and may be of any color. The container may be decorated with any number of labels, tags, stamps, engravings or other decorations or informational markings.

Figure 2:
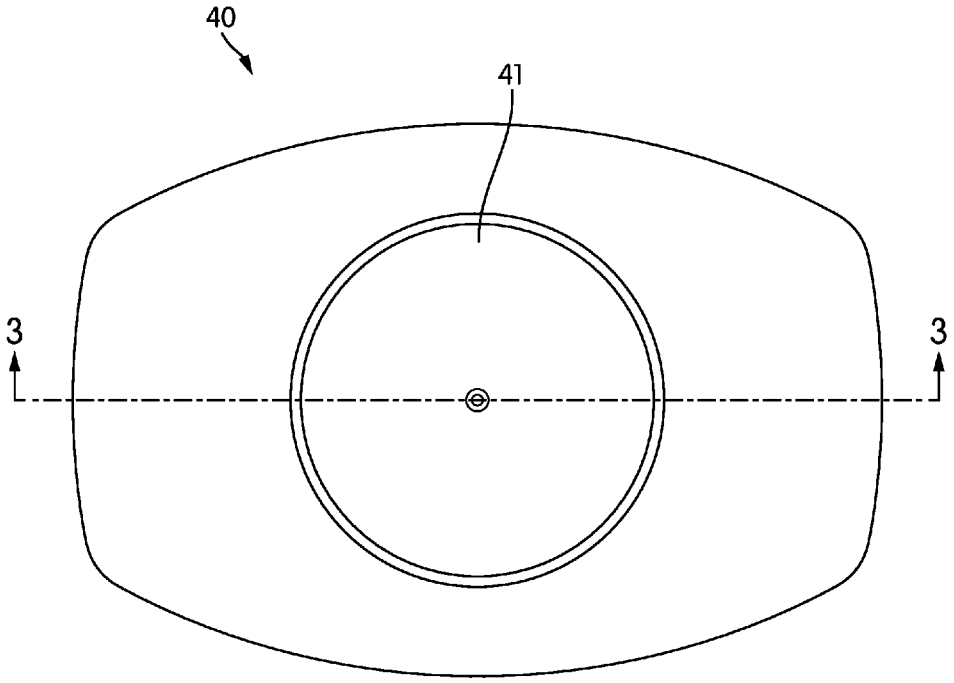
FIG. 2 is a top view of the embodiment of the threaded neck shown in FIG. 1, shown with a cap.

Referring to FIG. 2, a closure in the form of a twist cap 40 is shown from above. The twist cap 40 includes a substantially planar top surface 41. In this embodiment, the top surface 41 of the twist cap 40 is circular. However, in other embodiments the top surface 41 of the twist cap 40 can be any shape (e.g., square, rectangular, elliptical, tetrahedral, etc.) because the shape of the top surface 41 does not affect how the twist cap 40 engages with the neck 35 of the bottle 30.

Figure 3A:
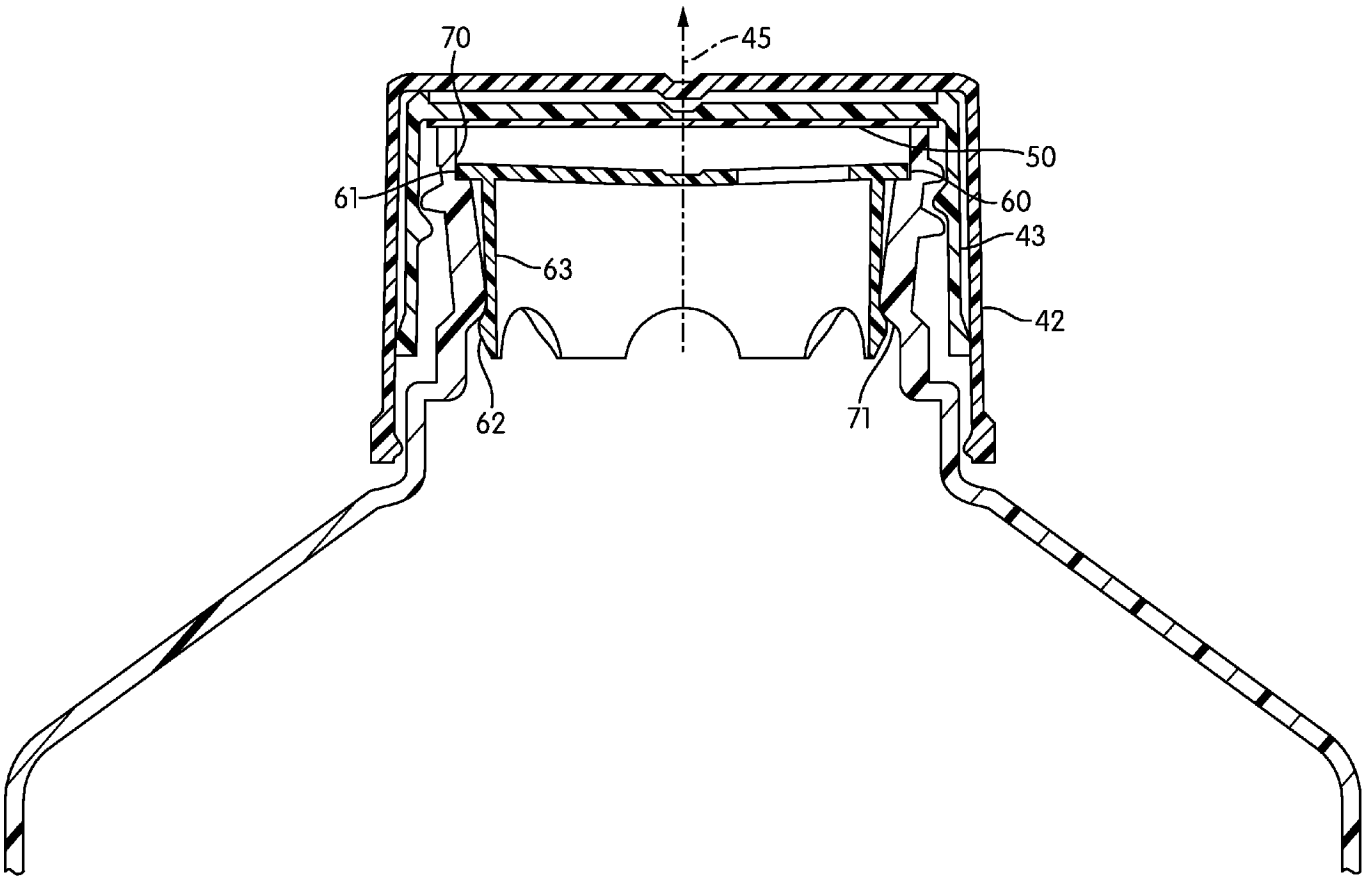
FIG. 3A is a cross-sectional view taken along 3-3 in FIG. 2, shown with a cap.

Referring to FIG. 3A, the neck 35 of the bottle 30 is shown engaging with the twist cap 40, the seal 50, and the fitment 60 in a cross-sectional view taken along section 3-3 from FIG. 2. The twist cap 40 includes not only the substantially planar top surface 41, but also a twist cap side wall 42, occasionally referred to as a skirt, that extends downward at an approximately 90 degree angle from the top surface 41. The twist cap 40 also includes an internal thread 43 adjacent to the internal surface of the twist cap side wall 42. The internal thread 43 of the twist cap 40 engages with the external thread 39 of the bottle 30 to secure the twist cap 40 onto the top sealing surface 38 of the bottle 30.

As shown in FIG. 3A, the neck wall 36 extends from the top sealing surface 38 of the bottle 30 to the shoulder 37 of the bottle 30. Directly above the top sealing surface 38 of the neck 35 of the bottle 30 is the seal 50. The placement of the seal 50 on the bottle 30 is unobstructed by either the twist cap 40 or the fitment 60. The seal 50 can be any type of seal that can be adhered to the bottle 30 by induction heating or by any other suitable means of coupling the seal 50 to the top sealing surface 38 (e.g., via an adhesive, via conductive heating, via a chemical reaction, etc.) to close or hermetically seal closed the bottle 30. Examples of different embodiments of the seal 50 include a sealing membrane or a sheet, and may include a metal foil layer or a layer of plastic depending on the contents 34 of the bottle 30.

The neck wall 36, which is shown in greater detail in FIG. 3A than in FIG. 1, may also include a recess or counterbore 70 directly below the top sealing surface 38 of the neck 35. The recess 70 does not affect the exterior surface of the neck wall 36, but does cut into the thickness of the neck wall 36 from the interior side. In one embodiment, the recess 70 has a width—or distance perpendicular to a longitudinal axis of the neck 45—of 0.088 inches. In other embodiments, the recess 70 has a width between approximately 0.085 inches and approximately 0.163 inches. In this embodiment, the recess 70 has a height—or distance parallel to the longitudinal axis of the neck 45—of approximately 0.163 inches. In an alternate embodiment, the recess 70 has a height of approximately 0.085 inches. In other embodiments, the recess has a height between approximately 0.085 inches and approximately 0.163 inches. In various embodiments, the height of the recess 70 is dependent on the dimensions of the fitment 60. The dimensions in these embodiments are only exemplary; dimensions may be higher or lower than the ranges suggested above depending on the application of the fitment 60, the application of the bottle 30, or the contents 34 of the bottle 30.

FIG. 3A shows a fitment 60. In one embodiment of the fitment 60, the fitment 60 comprises an upper flange 61, a lower flange 62, and a skirt 63 of material connecting the two flanges. In one embodiment, the upper flange 61 and the lower flange 62 are continuous sections curved radially outward around the circumference of the fitment. In other embodiments, the lower flange 62 may be missing sections of material in a variety of possible patterns (e.g., a scalloped pattern, a zigzag pattern, a ripple pattern, etc.) while still retaining the functional aspects of a flange. Embodiments that are missing sections of material in the lower flange 62 of the fitment 60 exhibit greater flexibility, a feature that may be desirable depending on the type of container and/or fitment.

Similarly, the skirt 63 of material in the fitment 60 may be a solid piece of material as shown in FIG. 3A. Alternatively, the skirt 63 of material may have portions of material removed without affecting the functionality of the fitment 60. Embodiments of the fitment 60 must include a skirt 63 with sufficient mechanical strength to maintain the relative placements of the upper flange 61 and the lower flange 62 in the bottle 30. In the embodiment of the fitment 60 shown in FIG. 3A, the skirt 63 is integrally formed out of the same material as the upper flange 61 and the lower flange 62. In other embodiments, the skirt 63 may be made of a different material than one or both of the upper flange 61 and the lower flange 62. The fitment 60 may also include additional elements not described herein, including a top planar surface, a perforated top surface, additional flanges, a liner, or other elements with functional or decorative purposes.

In one embodiment of the fitment 60, the skirt 63, the upper flange 61, and the lower flange 62 are integrally formed of a material with a thickness of approximately 0.045 inches. The upper flange 61 has a height—or distance parallel to the longitudinal axis of the neck 45—of approximately 0.045 inches, and the lower flange 62 has a height—or distance parallel to the longitudinal axis of the neck 45—of approximately 0.205 inches. In this embodiment, the height of the upper flange 61 of approximately 0.045 inches is less than the height of the recess 70 of approximately 0.085 inches. This arrangement, where the height of the upper flange 61 is less than the height of the recess or counterbore 70, makes it possible for the fitment 60 to be inserted into the neck 35 of the bottle 30 without obstructing the later application of the seal 50. The lower surface of the upper flange 61 of the fitment 60 engages with the upward facing surface of the recess 70 that is perpendicular to the longitudinal axis of the neck 45 in the neck wall 36 of the bottle 30. This inhibits the movement of the fitment 60 further into the bottle 30 than desired. The fitment 60 may experience a pressure or force that would otherwise force the fitment 60 into the cavity 33 of the bottle 30 for reasons such as decreased internal pressure following packing, stresses during the shipping and storage of the bottle 30, or from manipulations of the packaging by the end user. It is desirable to have the fitment 60 stay in place after insertion, and not shift around in the packaging.

In other embodiments, the thickness of the skirt 63, the upper flange 61, and the lower flange 62 may range between approximately 0.030 and approximately 0.500 inches. Similarly the height of the upper flange 61 and the height of the lower flange 62 may range between approximately 0.030 and 0.500 inches. The height of the upper flange 61 and the height of the lower flange 62 may be the same in a particular embodiment, or they may be different heights. The upper flange 61 may have a greater height than the lower flange 61, or vice versa depending on the purpose of the fitment, the type of the contents, and the other attributes of the bottle 30.

Similarly, as seen in FIG. 3A, the lower flange 62 engages with an internal rim 71 of the bottle 30. The internal rim 71 is the internal surface created at the shoulder 37 of the bottle 30. The shoulder 37, which couples the neck 35 with the side wall 32 and is integrally formed out of a single piece of material with both the neck wall 36 and the side wall 32, forms a surface that provides resistance to the fitment 60, preventing its removal after insertion into the neck 35 of the bottle 30.

Figure 3B:
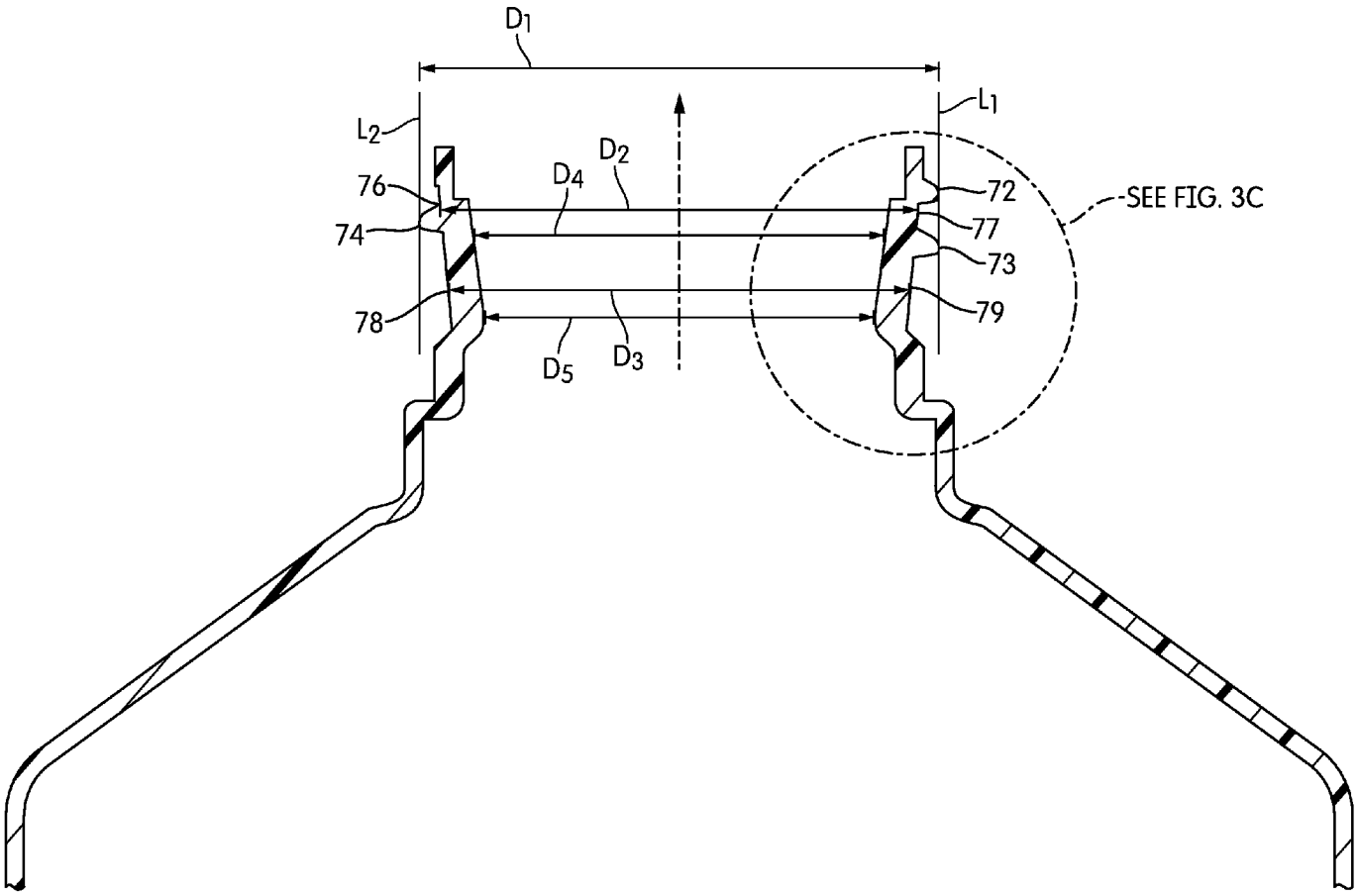
FIG. 3B is a cross-sectional view taken along 3-3 in FIG. 2, shown with the cap omitted.

Referring to FIG. 3B, the neck 35 of the bottle 30 is shown without any of the accompanying packaging components. The thread 39 of the neck 35 has several diameters. In various embodiments, the major diameter $D_1$ of the thread 39 has a range of values from approximately 1.02 inches to approximately 3.15 inches. In some embodiments, the major diameter $D_1$ of the thread 39 has a range of values from approximately 1.02 inches to approximately 1.89 inches. In one embodiment, the major diameter $D_1$ has a value of approximately 1.3 inches. The major diameter $D_1$ is constant throughout the length of the thread 39 on the neck 35 of any particular embodiment of the bottle 30; that is, the major diameter $D_1$ may be any value in the above ranges, but it will be only one of those values in a particular embodiment of the bottle 30. The dimensions in these embodiments are only exemplary; dimensions may be higher or lower than the ranges suggested above depending on the application of the fitment 60, the application of the bottle 30, or the contents 34 of the bottle 30.

Referring to FIG. 3B, another way of describing the outer diameter $D_1$ is the distance between a first line $L_1$ and a second line $L_2$. The first line $L_1$ is drawn between a first crest 72 of the thread 39 on the right side and a second crest 73 of the thread 39 on the right side, where the first crest 72 is located near the top sealing surface 38 and the second crest 73 is located near the shoulder 37. The second line $L_2$ is drawn in contact with a third crest 74 of the thread 39 on the left side, where the third crest 74 is located near the top sealing surface 38. In all embodiments, the first line $L_1$ and the second line $L_2$ are parallel to each other. In all embodiments, the first line $L_1$ and the second line $L_2$ are parallel to the longitudinal axis of the neck 45. The perpendicular distance between the first line $L_1$ and the second line $L_2$ is the outer diameter $D_1$.

Referring to FIG. 3B, the thread 39 also has a characteristic known as a minor diameter. In the embodiments of the bottles discussed herein, the minor diameter of the thread 39 is not constant along the longitudinal axis of the neck 45. In FIG. 3B, two such minor diameters are shown; a first minor diameter $D_2$ is shown near the top sealing surface 38 and a second minor diameter $D_3$ is shown near the shoulder 37 of the bottle 30. In the preferred embodiments, the first minor diameter $D_2$ is greater than the second minor diameter $D_3$. The minor diameters $D_2$ and $D_3$ are perpendicular to the longitudinal axis of the neck 45.

Another way of describing the diameters $D_2$ and $D_3$ as shown in FIG. 3B is by defining the diameters $D_2$ and $D_3$ by the roots of the thread 39. The second diameter $D_2$ can be defined as the distance between a first root 76 of the thread 39 on the left side and a second root 77 of the thread 39 on the right side, where the distance is perpendicular to the longitudinal axis of the neck 45. The first root 76 and the second root 77 are located near the top sealing surface 38 of the bottle 30. The third diameter $D_3$ can be defined as the distance between a third root 78 of the thread 39 on the left side and a fourth root 79 of the thread 39 on the right side, where the distance is perpendicular to the longitudinal axis of the neck 45. The third root 78 and the fourth root 79 are located near the shoulder 37 of the neck 35.

Referring to FIG. 3B, the neck wall 36 of the neck 35 of the bottle also has an internal diameter. Like the minor diameter of the thread 39, the internal diameter of the neck wall 36 is not constant along the length of the longitudinal axis of the neck 45. Two exemplary internal diameters of the neck wall 36 are shown in FIG. 3B; a first internal diameter $D_4$ and a second internal diameter $D_5$. Both the first internal diameter $D_4$ and the second internal diameter $D_5$ are perpendicular to the longitudinal axis of the neck 45. The first internal diameter $D_4$ is near the top sealing surface 38 of the bottle 30, and the second internal diameter $D_5$ is near the shoulder 37 of the bottle 30. The first internal diameter $D_4$ is always larger than the second internal diameter $D_5$.

In alternate embodiments, the engagement between the neck 35 of the bottle 30 and the cap 40 of the bottle 30 occurs without the use of threads on the neck 35 and the cap 40. Rather, the configuration of the neck 35 as discussed above is maintained, with the exception that the thread 39 is removed. In general, the cap includes a flange which interacts with the top of the neck to retain the cap on the neck. This interaction would be between the flange on the inside of the skirt of the cap and a ridge or other formation on located on the outside surface of the neck at the top of the neck.

In particular, in this alternate embodiment, the neck 35 of the bottle 30 retains the same structure of the neck wall 36 extending from the top sealing surface 38 to the shoulder 37 of the bottle. The internal diameter of the neck wall 36 remains irregular along the length of the longitudinal axis of the neck 45, and may be either frustoconical in shape or take another shape where the internal diameter adjacent to the top sealing surface 38 is greater than the internal diameter adjacent to the shoulder 37 of the bottle 30. The internal shape of the neck wall 36 includes both the recess 70 and the internal rim 71 that engage with a fitment 60 so that the fitment 60 does not interfere with the application of a hermetic seal 50. However, in this embodiment, the neck 35 of the bottle 30 does not have a thread 39 and does not engage with a twist cap 40. Instead, in one version of this alternate embodiment, the neck 35 of the bottle 30 includes a full or partial bead on the exterior surface of the neck wall 36 of the bottle. This full or partial bead structure engages with a cap that is pushed on and pulled off by the user when properly aligned with the full or partial bead structure.

Figure 3C:
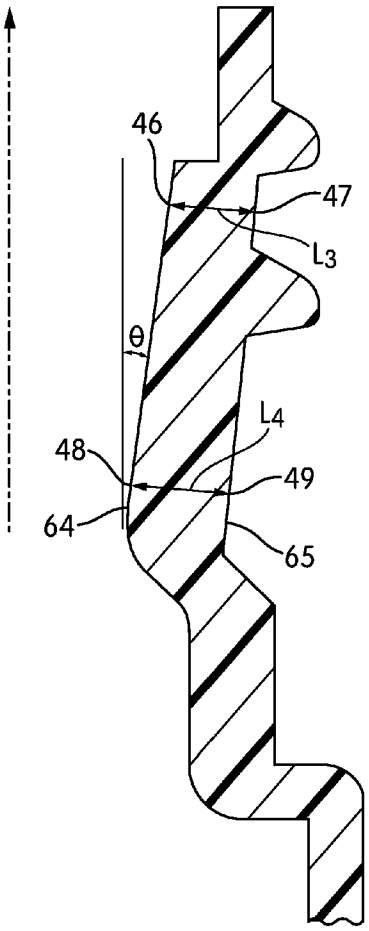
FIG. 3C is a close-up cross-sectional view of FIG. 3B.

Referring to FIG. 3C, an exploded view of the right side of the neck 35 shown in FIG. 3B, the slant of the neck wall 36 is shown. In this embodiment, the slant is a constant change in the internal diameter of the neck wall 36 over the longitudinal axis of the neck 45. However, in other embodiments the slant may not be constant over the length of the longitudinal axis of the neck 45, leading to alternative shapes of the neck wall 36. In embodiments such as the one shown in FIG. 3C, where there is a constant change of the internal diameter of the neck wall 36, the neck wall 36 has an angle θ that can be calculated. By measuring the length of the neck 35 along the longitudinal axis of the neck 45 from the top sealing surface 38 to the shoulder 37 of the bottle 30, the height of the neck 35 can be determined. By measuring the length of the neck 35 along the distance of the neck wall 36 when the neck wall 36 has a constant rate of change, the length of the neck wall 36 can be determined. The angle θ of the slant may subsequently be calculated by taking the inverse cosine function of the fraction given as the height of the neck 35 over the length of the neck wall 36. In this embodiment, the angle θ of the slant is approximately 5°. In alternate embodiments, the angle θ of the slant may be from approximately 1° to approximately 45°.

Referring to FIG. 3C, the approximately constant thickness of the neck wall 36 in this embodiment can be observed. A third line $L_3$ can be drawn through the neck wall 36, where the third line $L_3$ is not perpendicular to the longitudinal axis of the neck 45, but is instead perpendicular to the interior surface 64 of the neck wall 36. The third line $L_3$ connects a first point 46 and a second point 47, where the first point 46 is on the interior surface 64 of the neck wall 36 and the second point 47 is on the exterior surface 65 of the neck wall 36. The first point 46 and the second point 47 are close to the top sealing surface 38 of the bottle 30. A fourth line $L_4$ can be drawn through the neck wall 36, where the fourth line $L_4$ is not perpendicular to the longitudinal axis of the neck 45, but is instead perpendicular to the interior surface 64 of the neck wall 36. The fourth line $L_4$ connects a third point 48 and a fourth point 49, where the third point 48 is on the interior surface 64 of the neck wall 36 and the fourth point 49 is on the exterior surface 65 of the neck wall 36. The third point 48 and the fourth point 49 are close to the shoulder 37 of the bottle 30. In some, but not all, embodiments, the third line $L_3$ and the fourth line $L_4$ are parallel to each other. In preferred embodiments, the third line $L_3$ and the fourth line $L_4$ have approximately the same length.

Figure 4:
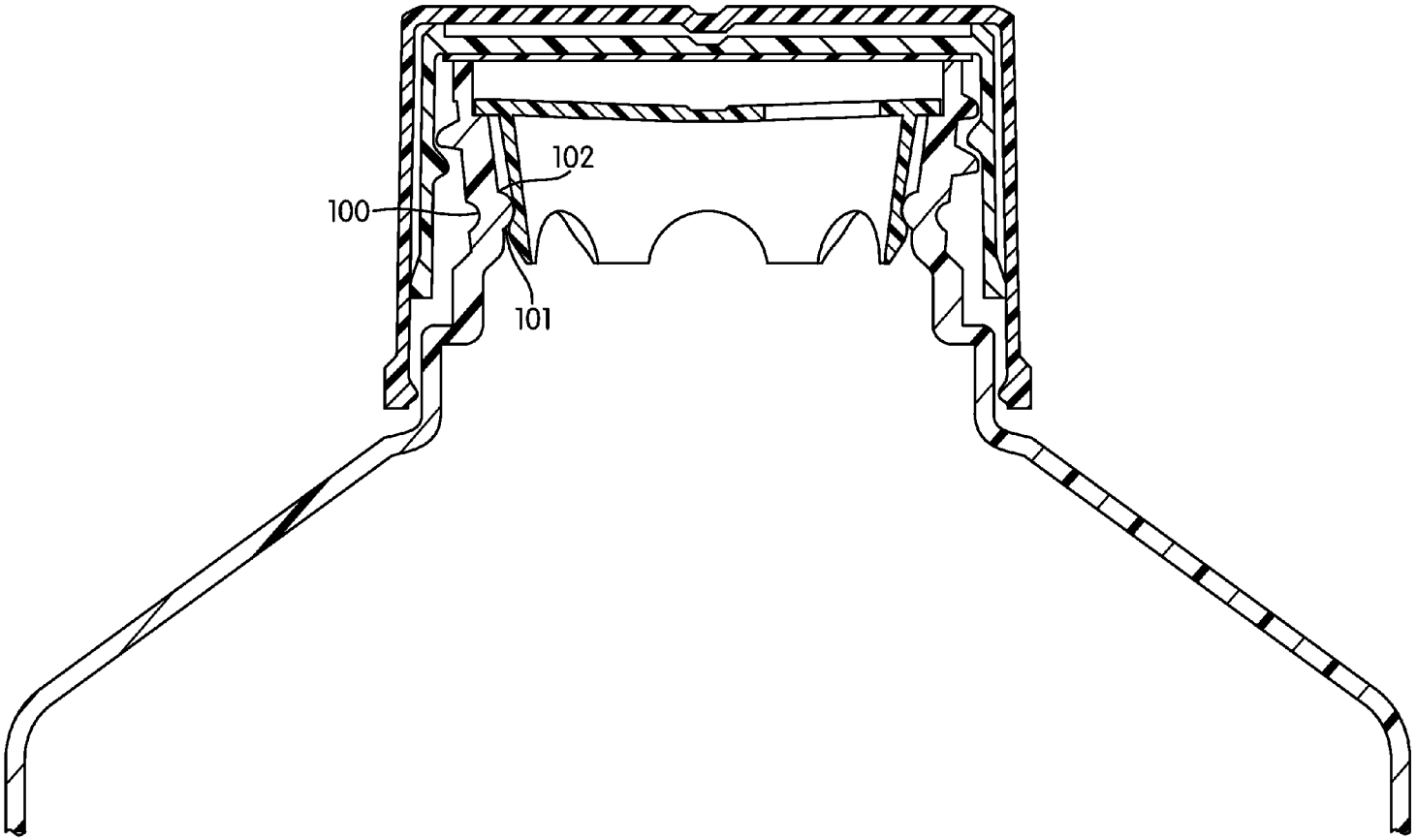
FIG. 4 is an alternate embodiment shown in a cross-sectional view taken along 3-3 in FIG. 2, where the neck of the bottle includes a snap bead.

Referring to FIG. 4, an alternate embodiment of the neck 35 of the bottle 30 is shown. In this embodiment, the neck 35 includes an additional bead, referred to here as a snap bead 100, that serves the same function as the shoulder in the embodiment in FIG. 3A. The snap bead 100 is identified by its shape—the crest 101 of the snap bead 100 extends inwards into the neck 35 of the bottle 30 instead of outwards away from the neck 35. Because the snap bead 100 extends inward, it has a bottom surface that engages with an inserted fitment 60. In one embodiment, the width of the snap bead 100 from the crest 101 to a root 102 of the snap bead, as measured perpendicular to the longitudinal axis of the neck 45, is approximately 0.332 inches. In other embodiments, the width is a value within the range of approximately 0.045 inches to approximately 0.650 inches. The width of the snap bead 100 is dependent on the internal diameter of the neck 35 of the bottle 30, as a larger neck 35 will allow for a wider snap bead 100.

Whatever the width of the surface, the snap bead 100 engages with the lower flange 62 of the fitment 60 to prevent the removal of the fitment 60 from the neck 35 of the plastic bottle 30. The possible advantage of the snap bead 100 is that it may allow for shorter fitments 60 in a bottle 30 with a long neck 35, because the fitment 60 does not have to extend the full length of the neck 35. Shorter fitments incorporate less material, and may also be more resistant to breakage. Another possible advantage of the snap bead 100 is that it can provide resistance to prevent removal of the fitment 60 from the neck 35 of the bottle 30 in a bottle 30 with a wide neck 35 and a small internal rim 71. The snap bead 100 also may be beneficial in a bottle 30 with an internal rim 71 that slopes so gradually—i.e., has a large radius of curvature—that engagement of the fitment 60 with the internal rim 71 poses problems due to diminished mechanical forces between the two pieces.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. Other substitutions, modifications, changes and omissions may also be made in the design, operating conditions and arrangement of the various exemplary embodiments without departing from the scope of the present invention.

What is claimed is:

1. A neck for a plastic container, wherein the neck extends a distance along a vertical axis, the neck comprising:

a top sealing surface;

at least one thread, wherein the thread has a major diameter that remains constant over the distance of the neck, and wherein the thread has a minor diameter that decreases along the distance of the neck, with the minor diameter greatest adjacent to the top sealing surface;

a layer of material of substantially constant thickness having an internal surface and an external surface, wherein the layer of material has an irregular internal diameter with the internal diameter adjacent to the top sealing surface being greater than the internal diameter adjacent to a shoulder, wherein the layer of material is integrally formed with the top sealing surface and the at least one thread, and is joined to a sidewall of the plastic container; and the shoulder formed by the internal surface of the layer of material adjacent to the sidewall of the plastic container, wherein the shoulder is configured to inhibit movement of a fitment inserted into the neck of the plastic container, wherein the fitment is comprised of a skirt connecting an upper flange and a lower flange.

2. The neck of claim 1 further comprising:

a recess on the internal surface of the layer of material, wherein the recess allows for the insertion of the fitment below a plane defined by the top sealing surface of the neck of the plastic container.

3. The neck of claim 2, wherein the internal and external surfaces of the layer of material are frustoconical.

4. The neck of claim 2, wherein the internal and external surfaces of the layer of material are hyperbolic.

5. The neck of claim 2, wherein the internal and external surfaces of the layer of material are parabolic.

6. The neck of claim 2, wherein the shoulder coupling the layer of material and the sidewall of the plastic container has a radius of curvature less than approximately 0.1 inches.

7. The neck of claim 2 further comprising:

a bead on the external surface of the plastic container extending outward, wherein the bead is further from the top sealing surface than the at least one thread.

8. The neck of claim 2 further comprising:

a bead on the internal surface of the neck located above the shoulder and below the midpoint of the vertical axis of the layer of material, wherein the bead inhibits removal of the fitment.

9. A threaded neck for a plastic bottle having a height along a vertical axis, the neck comprising:

a side wall of the threaded neck extending from a top sealing surface to a shoulder of the plastic bottle, wherein the side wall of the threaded neck has a substantially uniform thickness and defines a frustoconical internal surface and a frustoconical external surface, and wherein a first internal diameter of the internal surface proximate to the top sealing surface is greater than a second internal diameter of the internal surface proximate to the shoulder of the plastic bottle;

the shoulder coupling the side wall of the threaded neck with a side wall of the plastic bottle, wherein the shoulder forms an internal rim within the plastic bottle;

at least one thread extending around the external surface of the side wall from the top sealing surface toward the shoulder of the plastic bottle, wherein a major diameter as measured at a crest of the thread is constant and a first minor diameter as measured at a first root of the thread near the top sealing surface is greater than a second minor diameter as measured at a second root of the thread near the shoulder of the plastic bottle.

10. The neck of claim 9 further comprising:

a recess in the side wall adjacent the top sealing surface, wherein the recess supports a fitment within the neck below a plane defined by the top sealing surface of the neck, wherein the fitment is comprised of a skirt connecting an upper flange and a lower flange.

11. The neck of claim 10, wherein the frustoconical interior surface has an angle of five degrees.

12. The neck of claim 10, wherein the major diameter as measured at the crest of the thread is between 0.59 inches and 3.94 inches.

13. The neck of claim 10, wherein the recess has a depth of 0.010 inches below the plane coincident with the top sealing surface of the neck.

14. The neck of claim 10, wherein the height of the threaded neck is at least 1.110 inches.

15. The neck of claim 10, wherein the first internal diameter of the frustoconical interior surface excluding the recess is between 0.59 inches and 3.94 inches.

16. A plastic bottle comprising:

a neck defined by a neck wall extending from a top sealing surface to a shoulder, wherein the neck wall has a substantially uniform thickness and defines a frustoconical interior surface and a frustoconical exterior surface, wherein a first internal diameter of the interior surface proximate to the top sealing surface is greater than a second internal diameter of the interior surface proximate to the shoulder;

a side wall;

the shoulder coupling the neck wall with the side wall, wherein the shoulder forms an internal rim within the plastic bottle;

at least one thread extending around the exterior surface of the neck wall from the top sealing surface toward the shoulder, wherein a major diameter as measured at a crest of the thread is constant and a first minor diameter as measured at a first root of the thread at the top surface is greater than a second minor diameter as measured at a second root of the thread near the shoulder;

a bottom surface integrally formed with the side wall, enclosing a cavity in the plastic bottle;

a recess in the neck wall adjacent to the top sealing surface, wherein the recess supports a fitment in the neck of the plastic bottle below a plane coincident with the top sealing surface of the neck; and the fitment comprising a skirt connecting an upper flange and a lower flange, wherein the upper flange engages the recess, and the lower flange engages the internal rim to secure the fitment in the neck of the plastic bottle.

17. The bottle of claim 16, wherein the fitment is made of plastic.

18. The bottle of claim 16, wherein the fitment is inserted into the neck of the plastic bottle after the cavity of the plastic bottle is filled with contents.

19. The bottle of claim 16 further comprising:

a hermetic seal placed over the top sealing surface of the neck wall after insertion of the fitment into the neck of the plastic bottle.

20. The bottle of claim 16, further comprising:

a cap, wherein the cap has a substantially planar top surface, a skirt extending downwards away from the top surface, and at least one thread on an internal surface of the skirt, wherein the at least one thread on the cap engages with the at least one thread on the exterior surface of the neck wall of the plastic bottle.

21. A neck for a plastic container, wherein the neck extends a distance along a vertical axis, the neck comprising:

a top sealing surface;

at least one thread, wherein the thread has a major diameter that remains constant over the distance of the neck, and wherein the thread has a minor diameter that decreases along the distance of the neck, with the minor diameter greatest adjacent to the top sealing surface;

a neck wall having an internal surface and an external surface, wherein the neck wall has an irregular external diameter with the external diameter adjacent to the top sealing surface being greater than the external diameter adjacent to a shoulder, wherein the neck wall is integrally formed with the top sealing surface and the at least one thread, and is joined to a sidewall of the plastic container; and the shoulder formed by the internal surface of the neck wall adjacent to the sidewall of the plastic container, wherein the shoulder is configured to inhibit movement of a corresponding fitment inserted into the neck of the plastic container, wherein the fitment is comprised of a skirt connecting an upper flange and a lower flange.

22. The neck of claim 21 further comprising:

a recess on the internal surface of the neck wall, wherein the recess allows for the insertion of the fitment below a plane defined by the top sealing surface of the neck of the plastic container.

23. The neck of claim 22, wherein the external surface of the neck wall is frustoconical.

24. The neck of claim 22, wherein the shoulder coupling the neck wall and the sidewall of the plastic container has a radius of curvature less than approximately 0.1 inches.

25. The neck of claim 22 further comprising:

a bead on the external surface of the plastic container extending outward, wherein the bead is further from the top sealing surface than the at least one thread.

26. The neck of claim 22 further comprising:

a bead on the internal surface of the neck located above the shoulder and below the midpoint of the vertical axis of the neck wall, wherein the bead inhibits removal of the fitment.

* * * * *